United States Patent [19]

Shivers, Jr.

[11] 4,277,424

[45] Jul. 7, 1981

[54] CARBURETOR FOR INTERNAL COMBUSTION ENGINES

[76] Inventor: Charles B. Shivers, Jr., 8928 Valleybrook Rd., Birmingham, Ala. 35206

[21] Appl. No.: 105,919

[22] Filed: Dec. 21, 1979

[51] Int. Cl.[3] ..... F02M 3/02

[52] U.S. Cl. ..... 261/41 D; 123/DIG. 11; 261/51; 261/DIG. 20; 261/DIG. 74; 261/121 B; 261/DIG. 2

[58] Field of Search ..... 261/121 B, 41 D, DIG. 19, 261/DIG. 20, 51, DIG. 2, DIG. 74; 123/DIG. 11

[56] References Cited

U.S. PATENT DOCUMENTS

| | | | |
|---|---|---|---|
| 2,410,564 | 11/1946 | Bicknell | 261/DIG. 20 |
| 3,265,373 | 8/1966 | Walker et al. | 261/DIG. 19 |
| 3,547,089 | 12/1970 | Pierlot | 261/DIG. 19 |
| 3,618,581 | 11/1971 | Simonet | 261/69 R |
| 3,741,188 | 6/1973 | Rickey | 123/DIG. 11 |
| 3,795,237 | 3/1974 | Denton | 123/DIG. 11 |
| 4,050,436 | 9/1977 | Crabtree | 123/DIG. 11 |
| 4,096,213 | 6/1978 | Danger | 261/DIG. 2 |
| 4,124,662 | 11/1978 | Morita | 261/41 D |
| 4,129,620 | 12/1978 | Etoh | 261/18 R |

FOREIGN PATENT DOCUMENTS

| | | | |
|---|---|---|---|
| 2258549 | 6/1973 | Fed. Rep. of Germany | 123/DIG. 11 |
| 179122 | 3/1966 | U.S.S.R. | 261/DIG. 19 |

*Primary Examiner*—Tim R. Miles

*Attorney, Agent, or Firm*—Woodford R. Thompson, Jr.

[57] ABSTRACT

Disclosed is a carburetor for internal combustion engines having mechanism substantially to eliminate the effect on the engine of carburetor ice. When ice builds on the downstream face of the butterfly valve, on the side adjacent the idle jet, there is such a reduction of pressure at the mouth of the idle jet as to cause fuel starvation in the main jet, thus causing improper fuel air ratios or engine failure. To overcome this, mechanism is provided to vent the idle jet passage to atmosphere whenever the butterfly valve is in position for the main jet to become the primary source of fuel supply. Further, by venting the idle jet as indicated, the presence of ice on the butterfly valve will not produce the heretofore over-rich or lean mixtures, found to exist. Furthermore, such venting is useful for preventing dieseling in automobile engines.

2 Claims, 6 Drawing Figures

CARBURETOR FOR INTERNAL COMBUSTION ENGINES

This invention relates to carburetors for internal combustion engines, and while not limited thereto, is directed particularly to carburetors employed on aircraft engines.

One of the known and primary causes of aircraft engine failure is carburetor icing. My investigation into this problem leads me to believe that little real, sound information is available on carburetor icing, particularly with regard to the place or places in the carburetor where ice forms and the effect thereof on the operation of the engine.

My investigations have revealed that the cause of engine failure or partial failure due to carburetor ice comes about because ice builds up on the engine side (downstream side) of the butterfly valve.

Most aircraft carburetors (and, so far as I am aware, most automobile carburetors) are provided with both idling systems and main jet systems to supply the fuel to the air stream flowing through the carburetor body. In aircraft carburetors it is customary for the idle jet system to be in communication with the main jet system so that both of these systems may be shut off by means of a fuel control valve, as when shutting down the engine or leaning the mixture.

I have discovered that ice commences to form on the engine side of the butterfly valve on the side or quadrant thereof adjacent the idle jet. Thus, with the throttle valve in partially closed position the ice may cover substantially one-half of the butterfly valve; continued build-up of ice may occur on the side of the valve adjacent the idle jet even when the butterfly valve is in full open position. Thus, substantially the entire surface of the butterfly valve becomes covered with ice, which ice cake extends almost to the side walls of the carburetor body, adjacent the idle jet. In either partial or full open position of the butterfly valve there is a restriction of flow of air through the carburetor body adjacent the idle jet, resulting in a tremendous reduction in pressure at the mouth of the idle jet and in the idle jet system. Since this system is in communication with the main jet system, under either of these conditions I have discovered that instead of fuel being inspirated from the main jet, there is fuel starvation of that jet simply because there is greater negative pressure at the fuel supply end of the main jet than at the fuel discharge thereof. Under these cirmstances the main jet is starved of fuel. Since the effective diameter of the idle jet is less that that of the main jet the idle jet is too small to supply the requisite quantity for full engine operation. Furthermore, with partial build-up of ice on the butterfly valve and at partial opening of the butterfly valve, there can be a condition resulting in mixture so rich as to cause engine failure or at the least rough operation and a waste of fuel. Continued operation under the latter conditions, namely without changing the throttle setting, will result in engine failure due to over-rich mixture.

My invention also contemplates the elimination of "dieseling" in automobile engines by venting the idle fuel passage to atmosphere when the engine ignition system is deenergized.

A carburetor illustrating features of my invention is shown in the accompanying drawings forming a part of this application in which.

Figure 1:
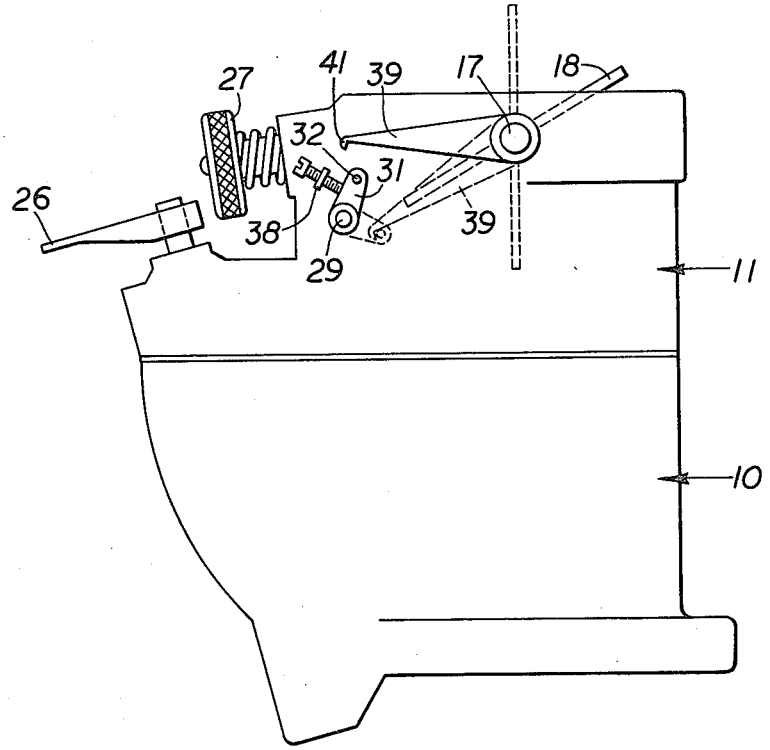
FIG. 1 is a side elevational view of a carburetor equipped with my improved mechanism.
Figure 2:
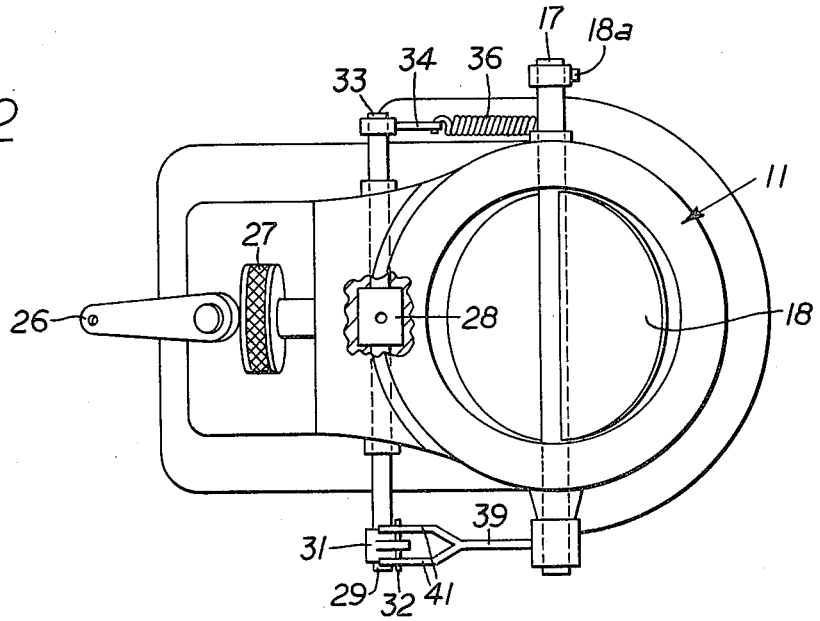
FIG. 2 is a plan view.
Figure 5:
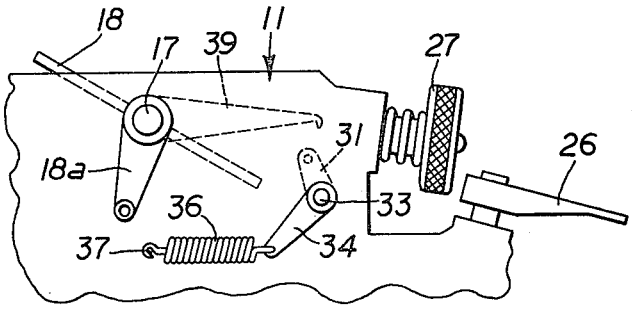
FIG. 5 is a detail fragmental view taken generally along line 5—5 of FIG. 2 and showing a portion of the side of the carburetor opposite that shown in FIG. 1; and, FIG. 6 is a view showing the application of my invention to an automobile carburetor in which the position of the idle jet control valve is determined by the engine ignition system.

Referring now to the drawings for a better understanding of my invention, I illustrate the same in association with a typical updraft carburetor which may be employed on aircraft engines. Thus, the carburetor comprises the lower section 10 and the upper section 11. As is known, the lower section may comprise a main jet 12, suitably placed relative to a venturi assembly 13 and drawing fuel through a passage 14. Fuel is supplied from a carburetor bowl a portion of which is indicated by the space 16.

The upper portion of the carburetor comprises a shaft 17 which carries a butterfly valve 18. An arm 18*a* on one end of shaft 17 may have connected thereto a throttle control wire or the like.

The idle system of the carburetor comprises the lower fuel passageway 19 which communicates with an upper fuel passageway 21. The idle jet 22 itself generally is simply a passage through the wall of the carburetor body.

It will be seen that the lower end of the passage 19 connects as at 23 to the main jet fuel supply passage 14.

At 24 I show the usual cut-off valve which is under control of a lever 26, which lever generally is connected to a suitable control in the cockpit of the aircraft. When this lever is turned to a certain position all of the fuel to both the jets 12 and 22 is cut off, stopping the engine.

Also, as will be understood, the idle jet 22 is adjustable by means of the threaded, manual screw 27.

My invention comprises means to vent the idle passage 21, to disenable or completely shut off the idle jet fuel supply whenever the throttle or butterfly valve is in substantially fuel open position. To this end I provide in the passage 21 a rotary valve 28. This valve may have a shaft, one end 29 of which projects past the carburetor body portion 11. Secured non-rotatably to the extending end 29 of the shaft is an arm 31. The free end of the arm 31 carries a pin 32.

The shaft carrying the valve 28 also has a projecting end 33, opposite the end 29. Non-rotatably secured to this end 33 of the shaft is an arm 34. A spring 36 is connected at one end to the free end of the arm 34 and at the opposite end to the body of the carburetor as at 37.

At 38 I show an adjusting screw which may be used to adjust the angular position of the shaft carrying valve 28.

Secured to the shaft 17 of the throttle valve is an arm 39. Arm 39 has a bifurcated end 41. This end is adapted to straddle the lower or free end of the arm 31 and for the side portions thereof to contact the pin 32, thus to rotate the shaft carrying the valve 28.

With the foregoing construction in mind, the advantages of my improved carburetor may be readily understood.

Figure 3:
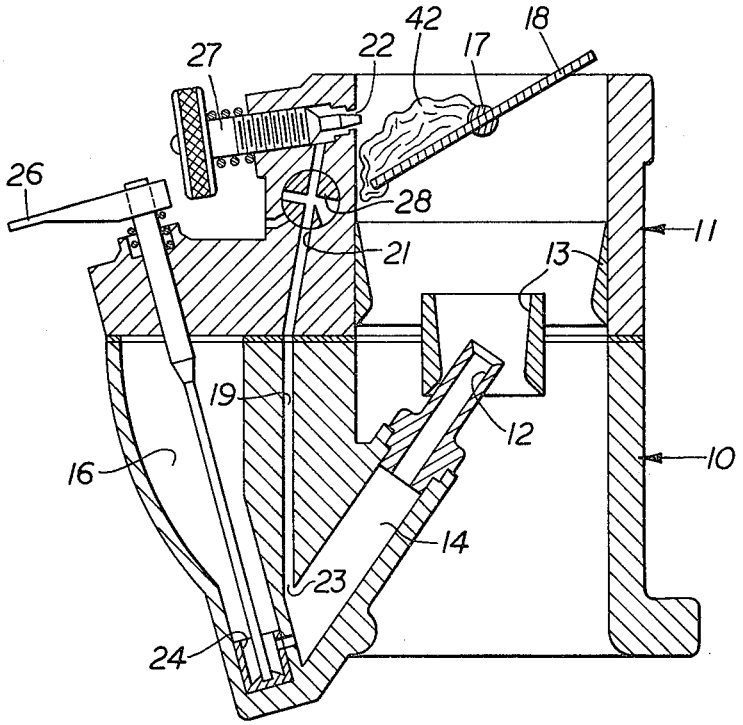
FIG. 3 is a detail sectional view taken generally along line 3—3 of FIG. 1 and showing a partial build-up of ice on the butterfly valve.

As before stated, ice as indicated at 42, FIG. 3, commences to build whenever the conditions for the same are correct, namely whenever the moisture-temperature conditions conducive to ice prevail in the body of air flowing through the carburetor. With the throttle set at slightly open position as shown in FIG. 3, and, with the ice commencing to build it will be apparent that there is a decrease in space between the body of ice and the mouth of the idle jet 22. In view of the fact that jet 22 and jet 12 both draw their fuel from the same common passageway 14, whenever the negative pressure at the end of jet 22 exceeds the negative pressure at the inspiration end of jet 12, fuel ceases to flow from jet 12 and can only flow through the idling jet 22.

Figure 4:
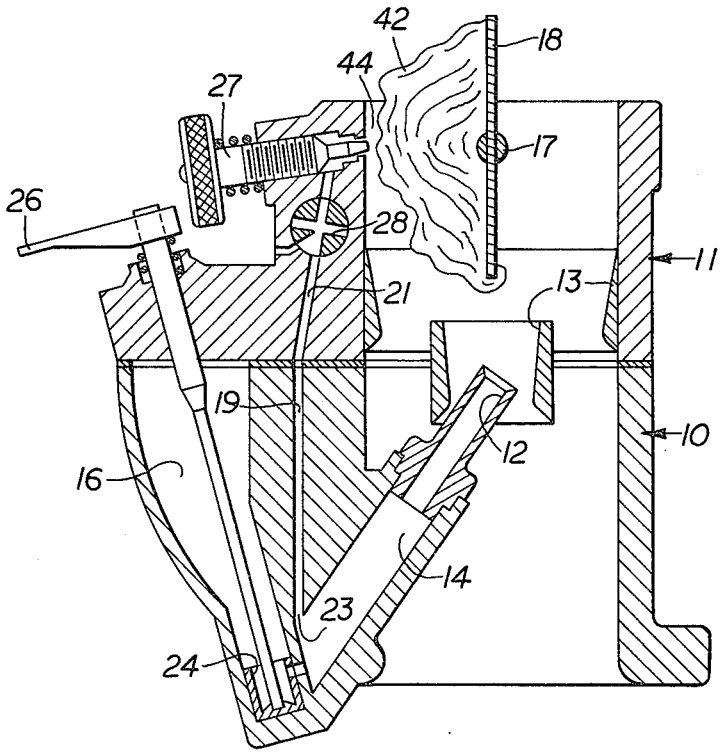
FIG. 4 is a view corresponding to FIG. 3 with the throttle valve in full open position and showing ice formed thereon, substantially covering the same.

Under the conditions shown in FIG. 4 of the drawings, ice has built substantially to the point of covering the entire upper or engine side of the throttle valve 18. With a carburetor not equipped with my improved vent valve for the idle jet, the passage between the discharge end of jet 22 and the ice indicated at 44, is so small that a tremendous velocity to pressure conversion takes place, thereby producing more negative pressure in the area indicated at 44 than exists at the mouth of the main jet 12. Under these conditions fuel is drawn only from the idle jet. However, with my improved carburetor it will be seen that with the throttle valve 18 moved substantially to the position shown in FIG. 4, that is, to the full open position, the valve 28 has been rotated to a position to vent the idle passage 21 to atmosphere, preventing the flow of fuel to the idle jet 22. Under these conditions, namely, with the valve 28 vented as shown in FIG. 4, the negative pressure on the fuel system, namely the passages 21, 19 and 14, due to the formation of ice, is removed. Therefore, the flow of air through the venturi system of the carburetor again becomes sufficient to draw fuel from the main jet 12, assuring continued operation of the engine.

From the foregoing it will be seen that the essence of my invention is the provision of means to vent to atmosphere the idle jet circuit of the carburetor so as to restore the "suction" on the end of the main jet.

Figure 6:
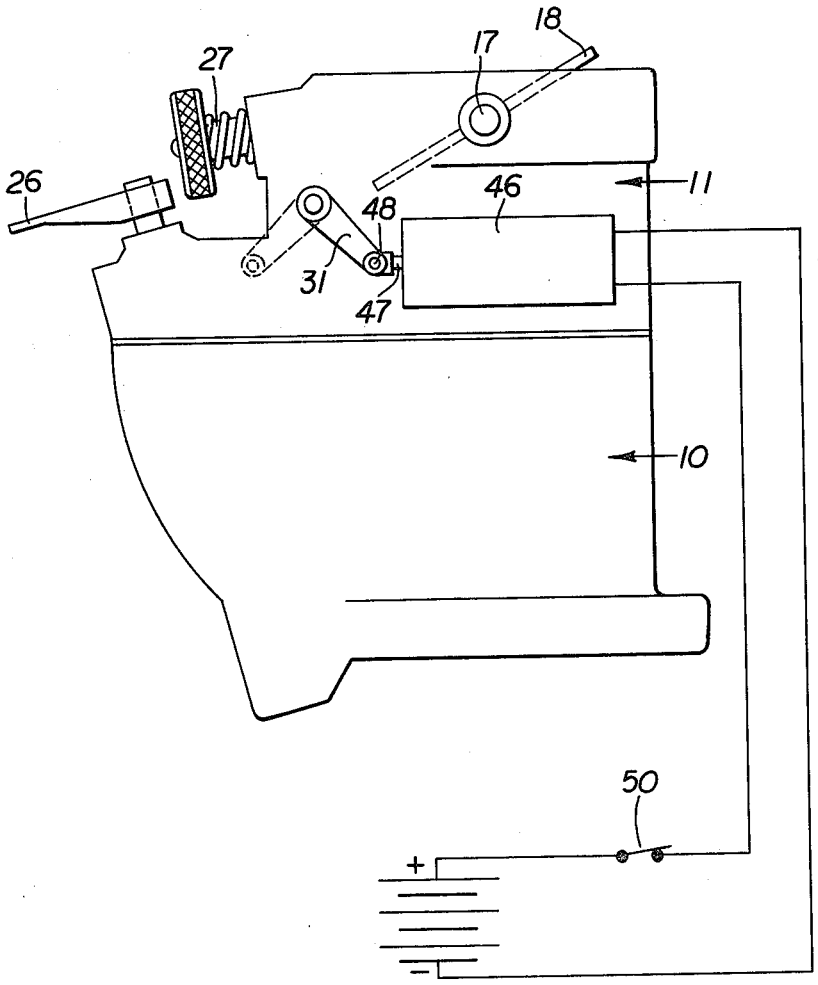

Referring to FIG. 6, I show the principle of my invention incorporated in a carburetor which may be used in the usual automobile or truck. Thus at 46 I show a solenoid having its armature 47 connected at 48 to arm 31 of the valve 28. The solenoid is in circuit with the ignition switch 50 of the vehicle so that when the ignition system is energized the solenoid likewise is energized. This holds the valve in the position of FIG. 3. When the ignition system is deenergized the solenoid is deenergized, permitting spring 36 to rotate the valve 28 to the vent position of FIG. 4. The venting of the idle passage to atmosphere instantaneously prevents fuel flow from the idle jet 22. Thus, when the ignition switch is opened, after-running or "dieseling" of the engine is prevented. In restarting, the moment the ignition switch is closed, the solenoid 46 returns the parts to the position of FIG. 3, permitting idle jet fuel to flow.

From the foregoing it will be seen that I have devised an improved, simple and efficient means for effectively eliminating the adverse effect of icing in carburetors for internal combustion engines and the elimination of "dieseling". As is understood, the volume of fuel compared to the volume of air required for efficient operation is very small. Thus, in the presence of ice in a carburetor not equipped with my improvement, the existence of only slightly more negative pressure at the mouth of the idle jet than exists at the discharge end of the main jet is adequate to cause complete cessation of flow of fuel from the main jet. While at first glance it would appear that with the icing conditions depicted in FIG. 4 and with the throttle valve fully open, there would be some flow of fuel from the main jet 12, such does not appear to be the case. With the engines that I have experimented with when iced as in FIG. 4, flow through nozzle 12 is not sufficient to keep the engine running, due to the lack of negative pressure at the end of the nozzle to inspirate the fuel. At the same time, due to the small size of the idle jet 22, such fuel as does come out of that jet is not sufficient. My invention thus assures, under conditions in which ice may be present, that fuel is drawn from the proper source, namely, through the main jet 12, which, due to its location away from the ice body on the butterfly valve is not per se affected by such ice. Furthermore, under certain intermediate throttle settings, in the presence of ice, it is known that over-rich mixtures occur. I have found that my improvement eliminates or greatly reduces such over-riching of the fuel-air mixture.

In summary, both with regard to aircraft and other internal combustion engines, my invention assures that fuel is supplied to the idle jet under those operating conditions when it is required or desired when a supply of fuel to the idle jet is not desired, as for example to eliminate "dieseling" or to save fuel, venting the same to atmosphere in accordance with my invention is a positive and prompt way to shut off such supply.

While I have shown my invention in but one form, it will be obvious to those skilled in the art that it is not so limited, but is susceptible of various changes and modifications without departing from the spirit thereof.

What I claim is:

1. In a carburetor for internal combustion engines of the kind having a main jet supplied by a fuel passage, and an idle jet having a fuel supply passage in communication with said main jet fuel supply passage, the improvement comprising, (a) a vent from the idle jet passage to atmosphere, (b) a valve controlling the idle jet passage ported so that in a first position the idle jet passage is connected to said vent and in a second position the idle jet passage is connected only to the idle jet, and (c) means operatively connected to the valve to move the same from said second to said first position when the main jet becomes the sole source of fuel flow through the carburetor.

2. Apparatus as defined in claim 1 in which the carburetor is equipped with a butterfly valve and in which the means to move said valve from said first to said second positions comprises a mechanical linkage between the butterfly valve and said valve, wherein said linkage is arranged to move the valve from said first position to said second position as the butterfly valve moves from substantially closed position to substantially open position.

* * * * *